US008672427B2

(12) United States Patent
Hammonds

(10) Patent No.: US 8,672,427 B2
(45) Date of Patent: Mar. 18, 2014

(54) VIDEO DISPLAY FOR PRODUCT MERCHANDISERS

(75) Inventor: Marcus Hammonds, New Rochelle, NY (US)

(73) Assignee: PepsiCo, Inc., Purchase, NY (US)

( * ) Notice: Subject to any disclaimer, the term of this patent is extended or adjusted under 35 U.S.C. 154(b) by 131 days.

(21) Appl. No.: 12/693,180

(22) Filed: Jan. 25, 2010

(65) Prior Publication Data

US 2011/0181792 A1 Jul. 28, 2011

(51) Int. Cl.
*A47F 3/04* (2006.01)

(52) U.S. Cl.
USPC ..... 312/116

(58) Field of Classification Search
USPC ..... 312/10.1, 7.2, 116, 234, 35; 348/745, 348/836; 353/74, 77
See application file for complete search history.

(56) References Cited

U.S. PATENT DOCUMENTS

| | | | | | |
|---|---|---|---|---|---|
| 1,282,298 | A | * | 10/1918 | Scott | 353/77 |
| 2,438,022 | A | * | 3/1948 | Rundle | 359/449 |
| 3,844,644 | A | | 10/1974 | Martinez | |
| 4,109,984 | A | * | 8/1978 | Gandara | 312/236 |
| 4,215,373 | A | * | 7/1980 | Goldenberg et al. | 348/781 |
| 4,439,027 | A | * | 3/1984 | Shioda et al. | 353/77 |
| 4,711,544 | A | | 12/1987 | Iino et al. | |
| 4,861,121 | A | * | 8/1989 | Gotz | 312/223.3 |
| 5,048,949 | A | * | 9/1991 | Sato et al. | 353/77 |
| 5,096,278 | A | | 3/1992 | Yoshioka et al. | |
| 5,129,309 | A | | 7/1992 | Lecuyer | |
| 5,248,917 | A | | 9/1993 | Hamagishi et al. | |
| 5,483,250 | A | | 1/1996 | Herrick | |
| 5,523,790 | A | * | 6/1996 | Kalua | 348/383 |
| 5,552,934 | A | * | 9/1996 | Prince | 359/629 |
| 5,831,862 | A | * | 11/1998 | Hetrick et al. | 700/232 |
| 5,927,985 | A | | 7/1999 | Lechner | |
| 6,016,183 | A | * | 1/2000 | Yamamoto | 352/100 |
| 6,021,626 | A | | 2/2000 | Goodman | |
| 6,301,916 | B1 | | 10/2001 | Navarro | |
| 6,366,451 | B1 | * | 4/2002 | Smock et al. | 361/679.22 |
| 6,454,415 | B1 | | 9/2002 | Vlahos | |
| 6,563,266 | B2 | | 5/2003 | Ok et al. | |
| 6,600,600 | B2 | | 7/2003 | Chen | |

(Continued)

FOREIGN PATENT DOCUMENTS

| | | |
|---|---|---|
| DE | 202004003242 | 6/2004 |
| EP | 1955616 | 8/2008 |

(Continued)

OTHER PUBLICATIONS

English translation of JP2006011783 (A).*

(Continued)

*Primary Examiner* — Darnell Jayne
*Assistant Examiner* — Hiwot Tefera
(74) *Attorney, Agent, or Firm* — Banner & Witcoff, Ltd.

(57) ABSTRACT

According to certain aspects of the disclosure, embodiments of a product merchandiser incorporating a video display is described. The product merchandiser described herein contemplates the use of a rear projector video system for display of video on a reflective film that is adhered to a glass or other transparent exposed surface on the merchandiser. Aspects of the merchandiser provided herein provide a cost-effective, durable, flexible/adaptable to different merchandiser sizes, and non-static means of displaying advertising or other promotions via video directly on an exposed surface of a product merchandiser.

13 Claims, 7 Drawing Sheets

(56) References Cited

U.S. PATENT DOCUMENTS

| | | | | |
|---|---|---|---|---|
| 6,805,447 | B2 * | 10/2004 | Takeuchi | 353/71 |
| 6,981,771 | B1 * | 1/2006 | Arai et al. | 353/74 |
| 7,036,021 | B2 * | 4/2006 | Koguchi et al. | 713/194 |
| 7,134,756 | B2 * | 11/2006 | Drucker et al. | 353/77 |
| 7,262,816 | B2 * | 8/2007 | McDowall et al. | 348/745 |
| 7,329,004 | B2 * | 2/2008 | Arai et al. | 353/8 |
| 7,502,819 | B2 * | 3/2009 | Alonso | 709/203 |
| 7,995,931 | B2 * | 8/2011 | Inami et al. | 399/12 |
| 2003/0209893 | A1 * | 11/2003 | Breed et al. | 280/735 |
| 2004/0114193 | A1 | 6/2004 | Inage et al. | |
| 2004/0198460 | A1 * | 10/2004 | Sakuta et al. | 455/566 |
| 2004/0252284 | A1 * | 12/2004 | Suzuki et al. | 353/77 |
| 2005/0002292 | A1 | 1/2005 | Komma et al. | |
| 2005/0094103 | A1 * | 5/2005 | Robinson et al. | 353/10 |
| 2005/0157180 | A1 * | 7/2005 | Takahashi et al. | 348/207.99 |
| 2005/0179825 | A1 * | 8/2005 | Hicks | 348/745 |
| 2005/0251287 | A1 | 11/2005 | Thornton et al. | |
| 2006/0036944 | A1 | 2/2006 | Wilson | |
| 2006/0038927 | A1 * | 2/2006 | Saletta | 348/745 |
| 2006/0038963 | A1 * | 2/2006 | Arai et al. | 353/77 |
| 2006/0061249 | A1 | 3/2006 | Kuo et al. | |
| 2006/0095628 | A1 | 5/2006 | Ludwig et al. | |
| 2006/0238658 | A1 * | 10/2006 | Dahlgren | 348/745 |
| 2007/0076251 | A1 * | 4/2007 | Yasuda | 358/1.15 |
| 2007/0088459 | A1 * | 4/2007 | Pollard et al. | 700/234 |
| 2007/0097329 | A1 * | 5/2007 | Ho et al. | 353/77 |
| 2007/0104477 | A1 * | 5/2007 | Misawa | 396/299 |
| 2007/0151134 | A1 | 7/2007 | Steinbrenner et al. | |
| 2007/0198107 | A1 | 8/2007 | Delgado | |
| 2007/0299298 | A1 * | 12/2007 | Suissa et al. | 600/27 |
| 2008/0007652 | A1 | 1/2008 | Choi | |
| 2008/0019660 | A1 * | 1/2008 | Matsumoto | 386/46 |
| 2008/0027946 | A1 | 1/2008 | Fitzgerald | |
| 2008/0051933 | A1 | 2/2008 | Vrachan et al. | |
| 2008/0136658 | A1 | 6/2008 | Brask | |
| 2008/0141242 | A1 | 6/2008 | Shapiro | |
| 2008/0158000 | A1 * | 7/2008 | Mattrazzo | 340/825.25 |
| 2008/0182644 | A1 * | 7/2008 | Lutnick et al. | 463/20 |
| 2008/0184679 | A1 * | 8/2008 | Jirele et al. | 55/283 |
| 2008/0252439 | A1 * | 10/2008 | Yamamoto et al. | 340/461 |
| 2008/0272912 | A1 * | 11/2008 | Ishida | 340/545.6 |
| 2009/0109350 | A1 * | 4/2009 | Koyama | 348/759 |
| 2009/0165343 | A1 | 7/2009 | Miller et al. | |

FOREIGN PATENT DOCUMENTS

| | | | | |
|---|---|---|---|---|
| GB | 2232520 | A * | 12/1990 | G09F 27/00 |
| JP | 6150126 | | 5/1994 | |
| JP | 9128615 | | 5/1997 | |
| JP | 2001245756 | | 9/2001 | |
| JP | 2003005293 | | 1/2003 | |
| JP | 2003256920 | A * | 9/2003 | |
| JP | 2006011783 | | 1/2006 | |
| JP | 2009103776 | A * | 5/2009 | |

OTHER PUBLICATIONS

English translation of JP2003256920 (A).*

JP 2009103776 english translation, Hiroshi Sasaki, May 2009.*

PCT/US2011/021860 International Search Report dated Apr. 4, 2011.

Thomas Kirste et al., EMBASSI: Multimodal Assistance for Universal Access to Infotainment and Service Infrastructures, Article, May 2001, pp. 41-50, Proceedings of the 2001 EC/NSF workshop on Universal accessibility of ubiquitous computing: providing for the elderly, Portugal.

Alfred Chen et al., The Research of possibility of Tangible Augmented Reality in the Application of Panel Design for Non-store vending machine, Article, 2007, pp. 1-24, Kun Shan University, Taiwan, Taiwan.

* cited by examiner

VIDEO DISPLAY FOR PRODUCT MERCHANDISERS

FIELD OF THE INVENTION

The invention relates to video displays for product merchandisers. More specifically, the invention relates to product merchandisers having a video display, created by a rear projection video assembly, on a glass or other surface of a product merchandiser.

BACKGROUND

Manufacturers of food and beverage products, as well as merchants, have long used product merchandisers to sell beverages, perishable and non/perishable food items, and other sundries at point of sale locations such as grocery stores, convenience stores, worksites, schools, hotels and other point of sale locations. Such merchandisers may comprise cooling units, to keep beverages cool or perishable food items fresh, or they may simply comprise a vending mechanism for vending non-perishable food items or other sundries.

Often such merchandisers target consumers at these point-of-sale locations by displaying advertising, logos, or other appealing presentations on the products or on the product merchandiser that stores and displays the products. Such advertising has become crucial for selling products and reaching consumers, such as the food and beverage products that are described above. Most products are associated with a manufacturer or company by a logo or other graphics associated with the container or product during the sales process.

It is common practice for manufacturers or vendors to apply or imprint a product merchandiser with graphics, logos, or other advertising indicia to attract consumers to the products at the point of sale. The graphics, logos, and other advertising indicia are typically affixed in a permanent fashion to the merchandiser and/or constitute static images. In many configurations, the graphics, logos, and other advertising is permanently applied to the housing structure of the merchandiser unit and may only be replaced by replacing the entire housing or a large portion of the housing. However, most advertising strategies frequently change, and replacing the merchandiser housing to reflect the current advertising may be inefficient, burdensome, and expensive.

SUMMARY

The following presents a general summary of the disclosure in order to provide a basic understanding of at least some of its aspects. This summary is not an extensive overview and is not intended to identify key or critical elements described further below or to delineate the scope of the disclosure. The following summary merely presents some concepts in a general form as a prelude to the more detailed description provided below.

According to certain aspects of the disclosure, examples and embodiments of a product merchandiser incorporating a video image display on a visible external surface of the merchandiser is described. As described herein, the cabinet of a product merchandiser may comprise a video display area housing a rear projection video projector. According to one embodiment described herein, the video projector may be positioned in the interior of a merchandiser cabinet/housing so that a video image is projected on a rear-reflective film adhered to a transparent surface (such as plastic or glass) on the interior surface of the cabinet. Accordingly, a video image is visible on the opposite, external, surface of the cabinet/housing.

According to another embodiment described herein, the video projector may be mounted on an exterior surface of a merchandiser cabinet, such that a video image is projected on a rear-reflective film adhered to a transparent surface (such as plastic or glass) on the interior surface of the cabinet, and a video image visible on the opposite, external, surface of the cabinet/housing.

BRIEF DESCRIPTION OF THE DRAWINGS

A more complete understanding of the present disclosure is illustrated by way of example in the following figures and is not limited by the accompanying figures in which.

Figure 1:
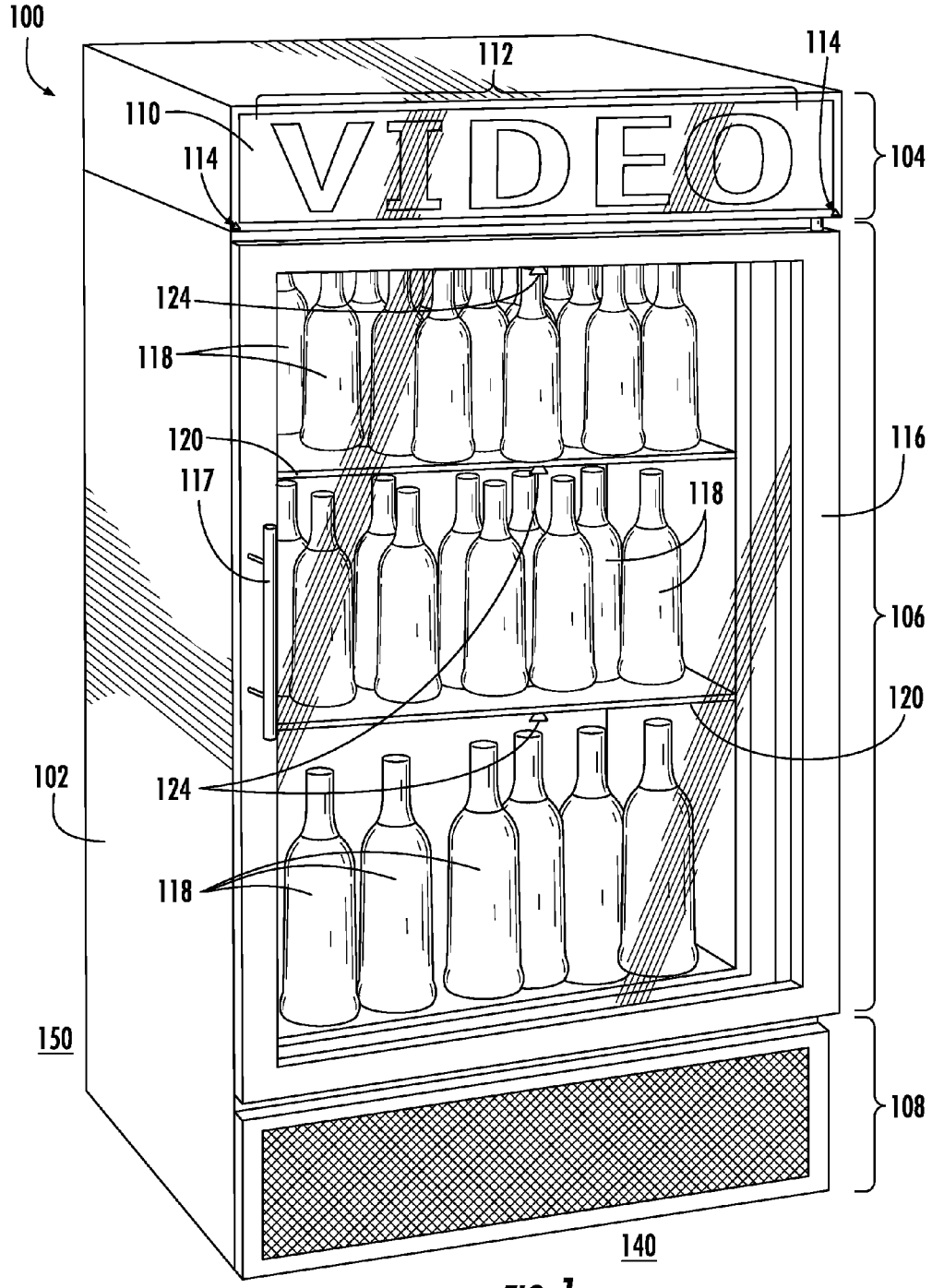
FIG. 1 illustrates a perspective view of an example of a product merchandiser incorporating a video display, according to aspects described herein.

The attached drawings are not necessarily drawn to scale.

DETAILED DESCRIPTION

In the following description of various example embodiments of the disclosure, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

A. General Description of a Product Merchandiser

In general, the disclosure relates to product merchandisers incorporating a video display on at least a panel of the product merchandiser. In accordance with at least some aspects of the disclosure, a product merchandiser may comprise a cabinet that encloses and defines an internal area configured to hold and display products. The cabinet may have a display area for displaying a product, a video display area for displaying video, and, if one or more products contained in the merchandiser must be cooled, a cooling portion configured to cool the product displayed in the display area.

The product merchandiser may be any device having an enclosed space for storing products, such as food and beverage products. Any products may be placed within the enclosed space of the product merchandiser. The product merchandiser may be any suitable size and shape. For example, the product merchandiser may be very large and may enclose a large space, such as a typical room for a walk-in refrigerator or freezer. In another example, a product merchandiser may be relatively small, such as a product merchandiser that may be positioned in a store or at another point of sale. The product merchandiser may be any suitable shape including, but not limited to a sphere, a cube or rectangular enclosure, or any other polygon shape. The cooler merchandiser may be any suitable three dimensional container.

The cabinet of a product merchandiser described herein may be constructed from any suitable material known to those skilled in the art including styrene, foam, metal (i.e., galvanized steel), wood, plastics, composite material, glass, and the like. For example, the cabinet may be made of a rigid styrene material, as conventionally available in the art. According to embodiments described herein, the cabinet may be made of a single type of material or may be created by combining and/or attaching a plurality of types of materials. Furthermore, one or more pieces may define the cabinet, and the one or more pieces may be of a unitary construction or may be individually formed. Each of the pieces may be any suitable shape and size.

The cabinet may define an interior area for housing one or more products. The interior area may have a top wall, a bottom wall, and a plurality of side walls. The top wall, the bottom wall, and the plurality of side walls may form a shape such as a cube, a cuboid, or any other three-dimensional shape. The top wall, the bottom wall, and the plurality of side walls may be attached together at any angle, such as a right angle, an acute angle, an obtuse angle, or any combination thereof. The top wall, the bottom wall, and the side walls may be flat or may have a curved surface. Each of the top wall, the bottom wall, and the side walls may be any suitable size and shape.

The cabinet may be capable of displaying products contained in the internal area. For example, the cabinet may have shelves or a display area for positioning products, such as food and beverage products. The display area may have any number of shelves. The shelves may contain any suitable material, including, but not limited to, plastics, wood, metals, and the like. The shelves may be stationary or pull-out type shelves and may include wire that form one or more slits in the shelf and define a surface upon which products may be displayed. The product display area may be a portion of the interior space defined by the cabinet. The product display area or a portion of the product display area may be visible from the exterior of the cooler merchandiser. An opening may provide access to the display portion to retrieve the products, as described in greater detail below. The display portion may include advertisements, shapes, colors, logos, props, product information or other features or information that may encourage a consumer to view and/or retrieve a product from the display portion of the housing.

The cabinet may also comprise a cooling portion that is configured to maintain a suitable environment within the display portion (interior space) of the cabinet. The cooling portion may be configured to maintain a suitable temperature for storing and/or displaying products within the display portion of the cabinet. The cooling portion may also be configured to maintain additional environmental characteristics of the display area, such as humidity, ventilation, air pressure, and any other environmental characteristic of the display portion. The cooling portion may be electrical and/or mechanical and may be fixedly or selectively attached to the display portion of the housing. For example, the cooling portion may include positioning one or more cooling devices, within the cabinet to cool the interior space and keep the products that are stored within the display portion cool, such as in a conventional insulated box (i.e., a "cooler"). The cooling portion may also be a conventional electro-mechanical device, such as a conventional compressor and condenser that are configured to maintain a suitable temperature and humidity within the display portion.

A product merchandiser as disclosed herein may also incorporate a video display on a surface of a portion of the cabinet, or on a surface positioned next to the cabinet. The video display may be created on a transparent surface, such as a glass or plastic surface, of the cabinet by use of a rear projection video projection positioned within the cabinet or otherwise engaged proximate the cabinet, as described below. The video image may be projected on a film or coating placed on a surface of the cabinet. The video display may be used for product description, advertisement, promotional or other messaging purpose. For example, the video display may be customized for a particular product or may be customized to target a particular group of consumers or possible users of the products.

A product merchandiser according to embodiments described herein may include at least one opening that provides access to products within the cabinet in the display area. A thermo-protective barrier may extend across the opening. The thermo-protective barrier may include a glass door, a thermo-protective barrier (such as a sheet designed to retractably extend across the opening), a ventilation system designed to maintain a protective air barrier across the opening, or any other suitable thermo-protective barrier. The thermo-protective barrier may extend across any portion of an opening. For example, the thermo-protective barrier may be a curtain that extends across the opening. In another example, the thermo-protective barrier may be a plastic or glass door that extends across the opening. The door may be opened via a hinge configuration, a sliding door configuration, or any other suitable arrangement.

A product merchandiser as described herein may also have more than one opening. In some example product merchandisers, a first opening may be positioned on a first side wall and a second opening may be positioned on a second side wall that is different from the first side wall. Still further examples may have several openings across an extended wall, such as large cooler merchandisers. Some example product merchandisers may have an opening positioned in a top wall as well.

B. Specific Examples of a Product Merchandiser

FIG. 1 illustrates a perspective view of an example of a product merchandiser 100 incorporating a video display 112, according to aspects described herein. Merchandiser 100 comprises external cabinet 102 that may enclose and define one or more external surface and interior areas such as video display area 104, product display area 106, and cooling unit area 108, each of which may comprise the entire portion of cabinet 102 from a front surface 140 to a rear surface 150. Cabinet 102 may further comprise an opening such as cabinet door 116 for retrieval of products 118 displayed within product display area 106. Cabinet 102 may be made from one continuous piece or a plurality of pieces (such as side panels, a rear panel, a front panel, a top panel or a bottom panel) or may be made and structured by any method known in the art without departing from the scope and intent of the disclosure.

Video display area 104 may be positioned at any location on cabinet 102 and may consist of a transparent surface 110 capable of displaying a video image 112 projected from a video projector contained within, or proximate to, video display area 104 of cabinet 102. Video projection according to exemplary embodiments described herein will be explained further below. External cabinet 102 may also comprise motion sensors or proximity sensors 114 for detecting the presence of a consumer. Motion/proximity sensors 114 will be discussed further below in relation to operation of a video display mechanism.

Products 118, stored within product merchandiser 100 on a plurality of racks or shelves 120, 122 in product display area 116, may be accessed by a hinged door 116 with handle 117. Door 116 may have a glass or plastic viewing front surface for viewing products 118 within the product display area 116. The embodiment depicted in FIG. 1 includes three racks 120, 122 (third not shown, but implied), however, in practice, a merchandiser may have more or fewer racks depending on the size of the merchandiser and/or the size of the products being displayed within. Thus, a product display area may be sized and shaped in a variety of ways to accommodate the numerous types, shapes and sizes of products that may be displayed in a merchandiser such as product merchandiser 100. Those skilled in the art will recognize that the disclosure is not limited to the exemplary embodiments depicted in FIGS. 1-4A, but may be fashioned in a variety of ways and still fall within the spirit and scope of the disclosure as contained herein. For example, the techniques described herein may be implemented on product merchandisers such as product vending machines, including food, cigarette and sundries vendors, as well as on beverage dispensers.

Product display area 106 of the interior of cabinet 102 may further comprise one or more light(s) 124 for illuminating products contained in the merchandiser 100. Operation of light(s) 124 are discussed further below in relation to operation of an embodiment of a video display mechanism.

Cooling unit area 108 of cabinet 102 may comprise any form of cooling unit known in the art such as any combination of a conventional electro-mechanical compressor and condenser, or other cooling mechanism. Cooling unit area 108 may provide temperature control to product display area 106.

Figure 2:
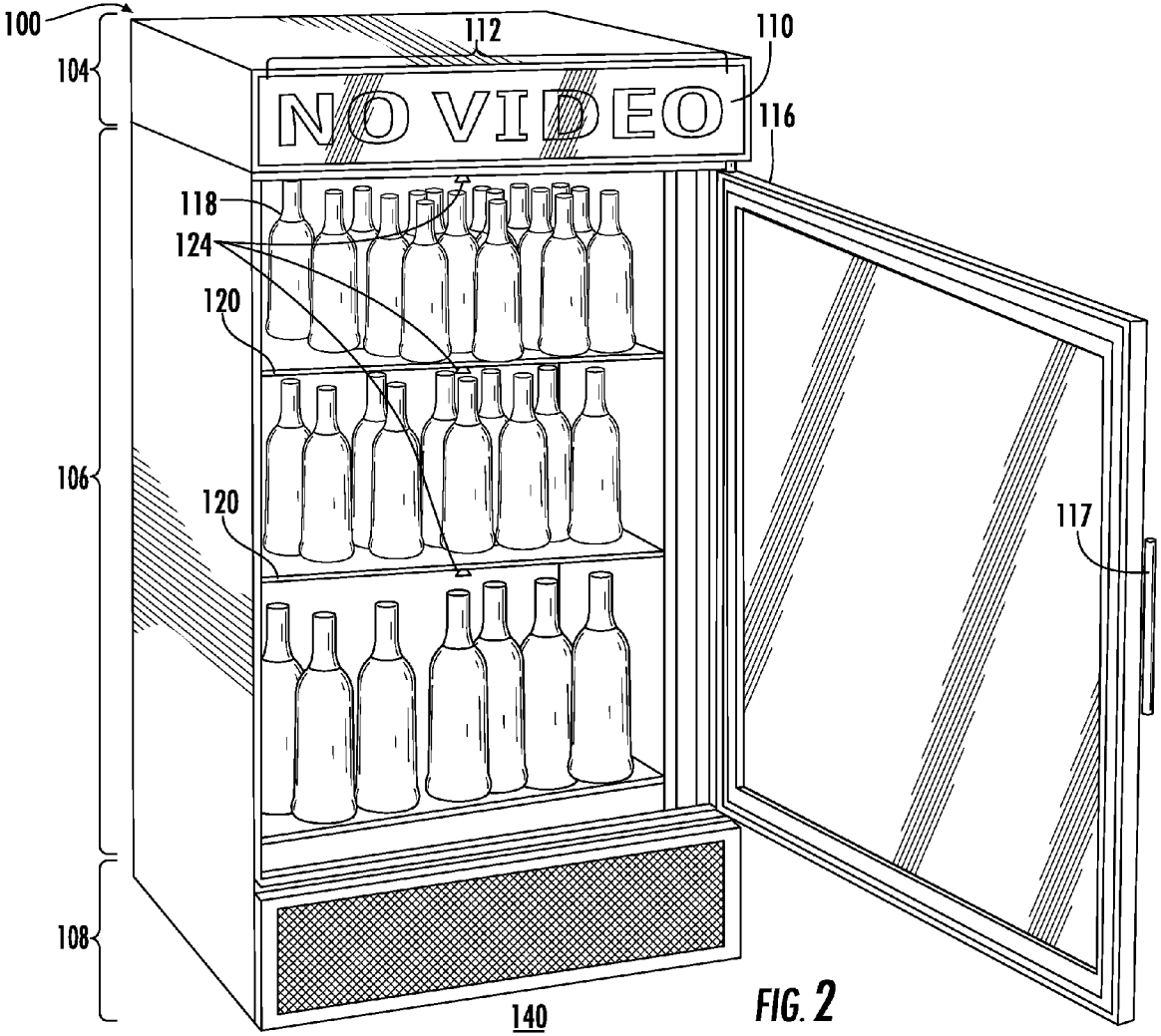
FIG. 2 illustrates a front view of an example embodiment of a product merchandiser incorporating a video display, wherein the product merchandiser door is open, according to aspects described herein.

FIG. 2 illustrates a front view of the example product merchandiser 100 depicted in FIG. 1 with door 116 open. As seen in FIG. 2 and described further below in relation to operation of a video display mechanism, when door 116 is opened by a consumer, video display 112 may be paused by a video display control mechanism or switch 126. Such a mechanism may comprise a microcontroller configured to communicate with a video projector and other components of merchandiser 100, such that when the door is opened by a consumer, the microcontroller signals the video projector to pause. When the door is subsequently closed, the microcontroller signals the video projector to resume the video display. Door 116 may further control a switch for interior light(s) 124 such that opening door 116 causes light(s) 124 to illuminate, as understood in the art. In addition, video display 112 may also be controlled manually by use of display control mechanism 126. However, the operation of video display 112 and light(s) 124 may be controlled in a variety of ways and by a variety of mechanisms known in the art, and the present disclosure should not be interpreted as limited to any such switch or control mechanism. For example, video display control mechanism or switch 126 may be located in any location near, on or within cabinet 102 and may comprise a simple electromechanical switch in communication with a video projector (not shown in FIGS. 1 and 2), as is known in the art, a microcontroller in communication with a video projector, or may be incorporated directly on a video projector.

Figure 3:
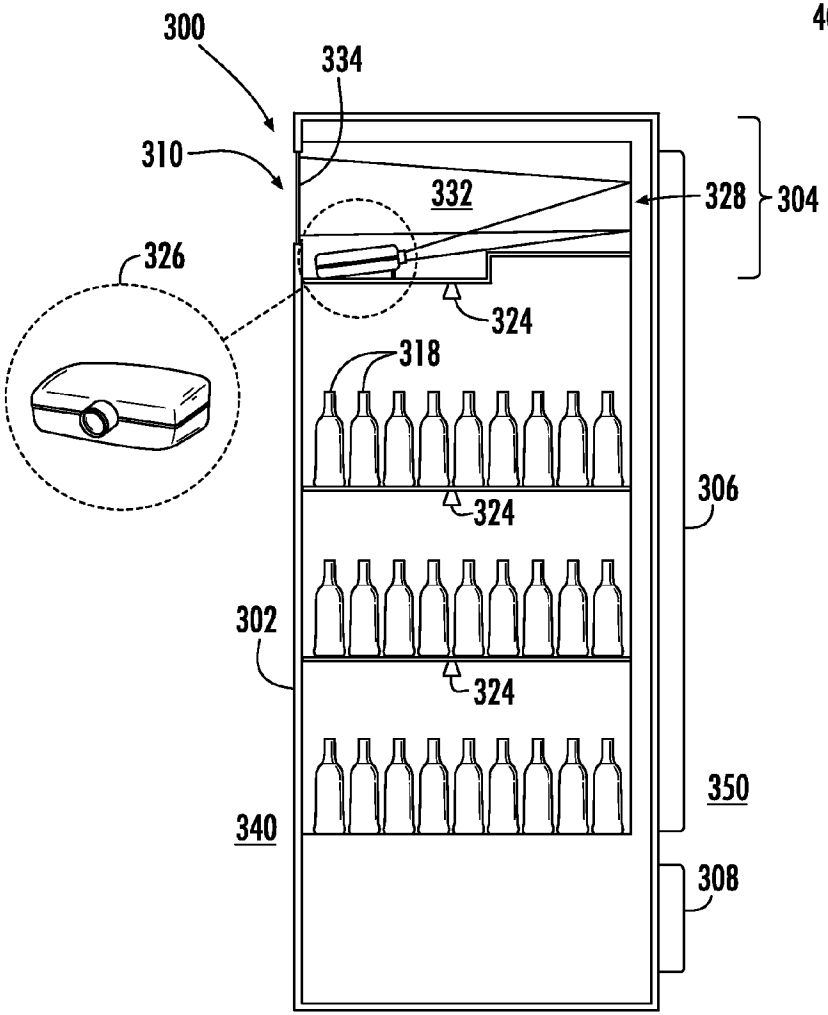
FIG. 3 illustrates a cross-sectional view of one embodiment of a product merchandiser incorporating a video display, according to aspects described herein.
Figure 3A:
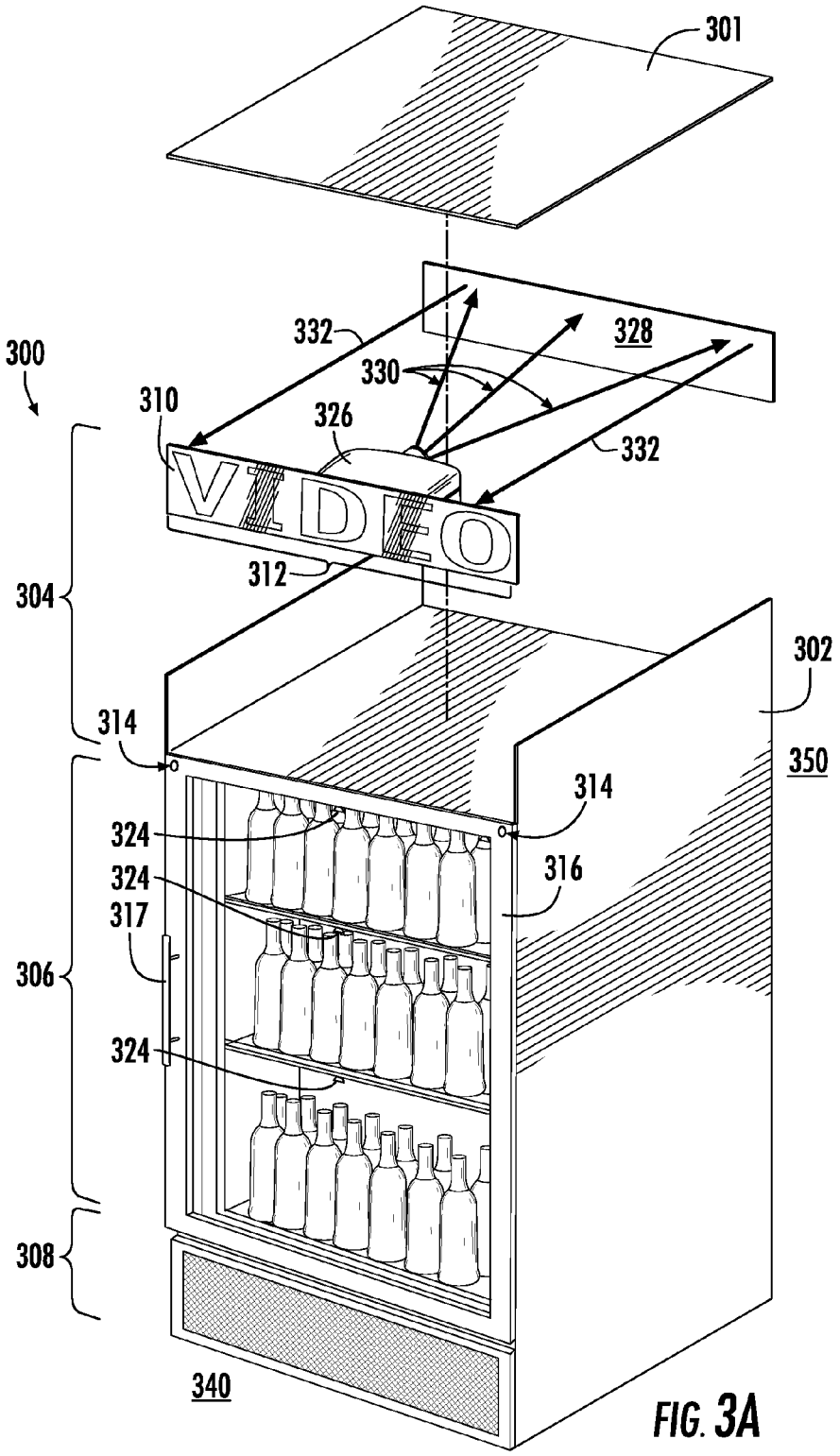
FIG. 3A illustrates an exploded front perspective view of certain components of the exemplary embodiment depicted in FIG. 3.

FIGS. 3 and 3A illustrate a cross-sectional and exploded view, respectively, of one exemplary embodiment of a product merchandiser 300 with video display assembly, according to aspects described herein. Similar to the merchandiser 100 depicted in FIGS. 1 and 2, merchandiser 300 comprises external cabinet 302 that may enclose and define one or more cabinet areas such as video display area 304, product display area 306, and cooling unit area 308. Such areas may be defined as comprising a vertical section of the cabinet as shown in FIGS. 3 and 3A from a front surface 340 to a rear surface 350. Cabinet 302 may also be constructed from one continuous piece or from a plurality of pieces (such as side panels, a rear panel, a front panel, a top panel or a bottom panel) or may be made and structured by any method known in the art without departing from the scope and intent of the disclosure.

Products 318 may be stored and displayed within product display area 306 in product merchandiser 300. Products 318 may be accessed by a hinged door 316 with handle 317. Door 316 may have a glass or plastic viewing front surface located proximate a front surface 340 of cabinet 302 for viewing products 318 within the product display area 306. Those skilled in the art will recognize that a product display area may be sized and shaped in a variety of ways to accommodate the numerous types, shapes and sizes of products that may be displayed in a merchandiser such as product merchandiser 300.

Product display area 306 in the interior of cabinet 302 may further comprise one or more light(s) 324 for illuminating products contained in the merchandiser 300, and operation/illumination of light(s) 324 may be triggered by a switch connected to cabinet door 316 such that when cabinet door 316 is opened, lights 324 illuminate for better viewing of products 318. Those skilled in the art will recognize that product merchandisers described herein, such as merchandiser 300, may be embodied with a variety of different openings suitable for accessing products 318, including, but not limited to a sliding door or a vending flip-up door, without departing from the invention as defined herein.

According to an exemplary embodiment, merchandiser 300 may further comprise a cooling unit area 308 for housing a cooling unit known in the art, such as any combination of a conventional electro-mechanical compressor and condenser, or other cooling mechanism. Cooling unit area 308 may provide temperature control to product display area 306.

According to the exemplary embodiment depicted in FIGS. 3 and 3A, video display area 304 may be positioned at the top of cabinet 302 and may consist of a transparent surface 310, or any other surface, capable of displaying a video image (not shown) projected from a rear-projection video projector 326 positioned within cabinet 302 in video display area 304. According to aspects of the disclosure, in order to display a video image on surface 310, wherein the video image may be viewed from the exterior front surface of the cabinet 302, video projector 326 may project a stored video image 312 along path 330 onto a mirror 328 positioned on an interior surface at the rear of cabinet 302. From mirror 328, video image 312 may be projected along path 332 at a rear reflective film 334 that may be adhered to the interior surface of the surface 310. By nature of film 334, video image 312 will be viewable from the front of the surface 310, i.e., proximate the front surface 340 of cabinet 302.

Video projector 326 may comprise any rear projection video projector known in the art. Example video projectors suitable for use in implementing aspects of the present invention include the Samsung® P400 Model or the LG® Ultra Mobile Projector, and those skilled in the art will recognize other appropriate video projectors for use in implementing the described embodiments. Rear reflective film 334 may comprise any transparent reflective film that may be laminated onto a transparent surface, such as plastic or glass, for use as a rear projection screen. One such film suitable for use in implementing aspects described herein is the 3M® Vikuiti® Rear Projection Film, however, those skilled in the art will recognize and be able to implement other such films for implementing aspects described herein.

Video projector 326 may be configured to receive video image for playback via an SD card, thumb drive, or the like. Video projector 326 may also be configured to receive video data via a network connection such as a direct Ethernet connection or wireless network connection.

According to aspects described herein, video projector 326 may be in communication with and/or controlled by a microcontroller, internal to the projector or otherwise (not shown), and may be configured to continuously play one or more selected video images. Video projector 326 may also be configured to begin playback or end playback based on an external event. For instance, cabinet 302 may comprise proximity sensors 314 configured to communicate with video projector 326 or microcontroller, such that proximity data received by video projector 326 from proximity sensors 314 may trigger projector 326 to begin or pause playback. In yet another embodiment contemplated herein, video projector 326 may be configured to pause playback when door 316 is opened by a consumer for product retrieval.

Figure 4:
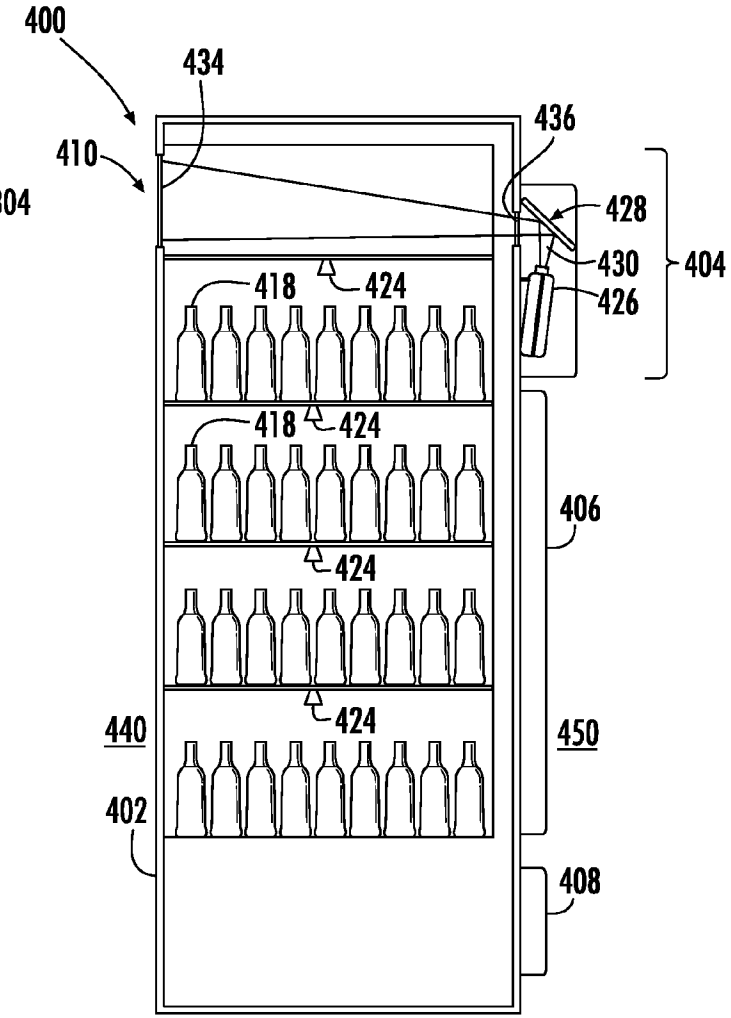
FIG. 4 illustrates a cross-sectional view of another embodiment of a product merchandiser incorporating a video display, according to aspects described herein.
Figure 4A:
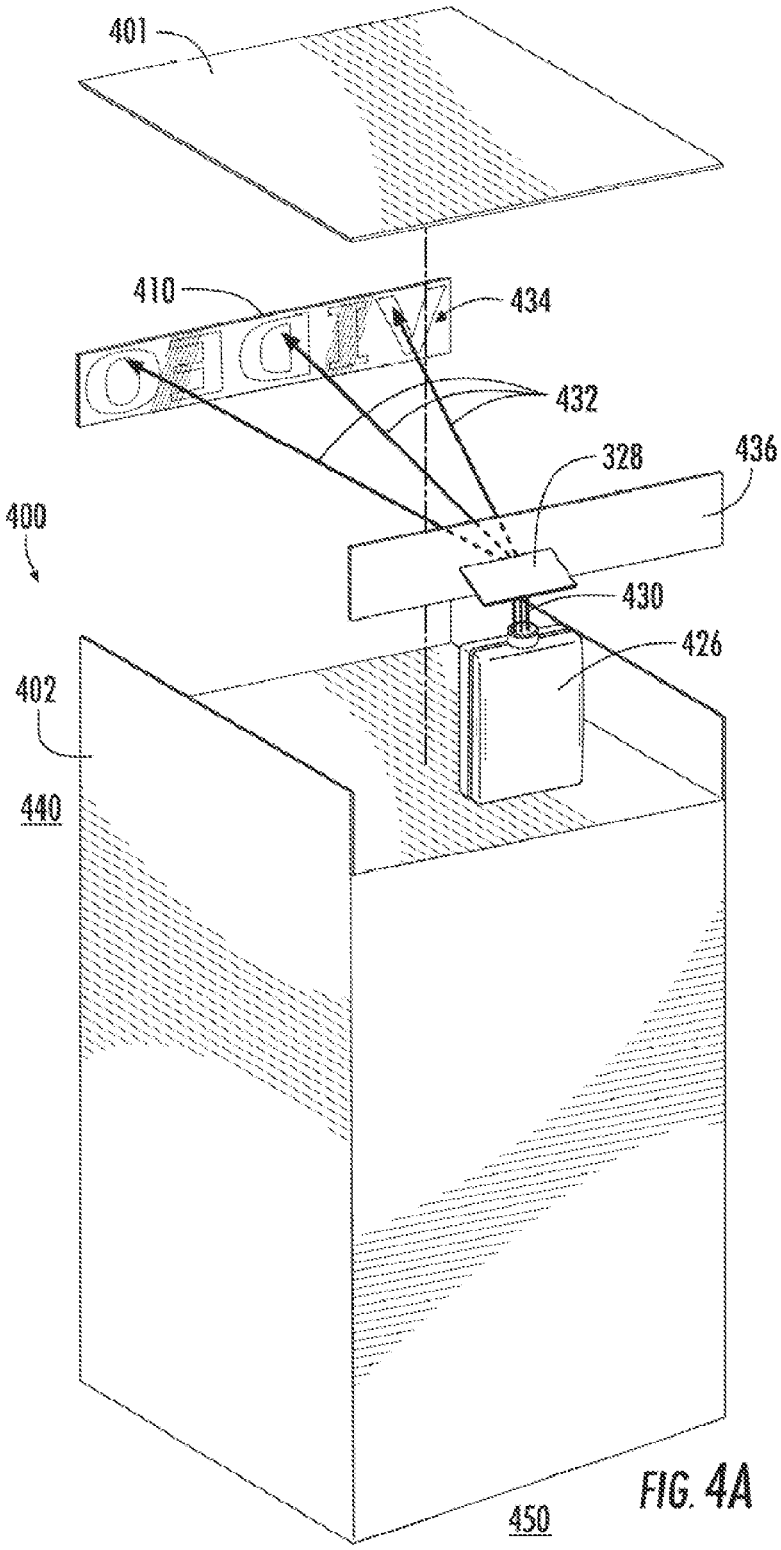
FIG. 4A illustrates an exploded rear perspective view of certain components of the exemplary embodiment depicted in FIG. 4.

FIGS. 4 and 4A illustrate a cross-sectional and exploded view, respectively, of still another exemplary embodiment of a product merchandiser 400 with video display assembly 404, according to aspects described herein. Similar to the merchandisers previously described, merchandiser 400 comprises external cabinet 402 that may enclose and define one or more areas such as video display area 404, product display area 406, and cooling unit area 408. Products 418 may be displayed within product display area 406 inside cabinet 402. Cabinet 402 may be constructed from a plurality of pieces (such as side panels, a rear panel, a front panel, a top panel or a bottom panel) or may be made and structured by any method known in the art without departing from the scope and intent of the disclosure.

Products 418, stored within product merchandiser 400 on one or more racks or shelves 420 in product display area 406, may be accessed by a hinged door on the front surface of cabinet 402 (not shown in figures). Those skilled in the art will recognize that a product display area may be sized and shaped in a variety of ways to accommodate the numerous types, shapes and sizes of products that may be displayed in a merchandiser such as product merchandiser 400. Product display area 406 in the interior of cabinet 402 may further comprise one or more light(s) 424 for illuminating products contained in the merchandiser 400, and operation/illumination of light(s) 424 may be triggered by a switch connected to a cabinet door or opening such that when a cabinet door is opened, or other opening is otherwise opened, lights 424 illuminate for better viewing of products 418.

According to an exemplary embodiment, merchandiser 400 may further comprise a cooling unit area 408 for housing a cooling unit known in the art, such as any combination of a conventional electro-mechanical compressor and condenser, or other cooling mechanism. Cooling unit area 408 may provide temperature control to product display area 406.

According to the example embodiment depicted in FIGS. 4 and 4A, video display area 404 may be positioned at the top of cabinet 402 and may consist of a transparent surface 410, or any other suitable surface, capable of displaying a video image (not shown) projected from a rear-projection video projector 426 mounted on the outside of cabinet 402. According to aspects of the disclosure, in order to display a video image on surface 410, wherein the video image may be viewed from the front surface 440 of the exterior of cabinet 402 on surface 410, video projector 426 may project a stored video image along vertical path 430 onto a mirror 428 positioned at an angle transverse to the vertical axis of cabinet 402 such that video image is deflected through an opening 436 in the rear of cabinet 402. From mirror 428, video image may be projected along path 432 at a rear reflective film 434 that may be adhered to the interior surface of surface 410. Video projector 426 may comprise any rear projection video known in the art, such as the specific exemplary projectors identified above. Further, rear reflective film 434 may comprise any transparent reflective film that may be laminated onto a transparent surface, such as plastic or glass, for use as a rear projection screen, including the specific exemplary rear reflective films identified above.

Video projector 426 may be configured to receive video image for playback via an SD card, thumb drive or via a network connection such as a direct Ethernet connection or wireless network connection, as described above. In addition, video projector 426 may communicate with and be controlled by a microcontroller, internal or otherwise (not shown) and may be configured to continuously play one or more selected video images, or may be configured to begin playback or end playback based on an external event. For instance, as described above, cabinet 402 may comprise proximity sensors (not shown in figures) configured to communicate with video projector 426, or a microcontroller in communication with video projector 426, such that proximity data received by video projector 426 from such proximity sensors may trigger projector 426 to begin or pause playback. In yet another embodiment contemplated herein, video projector 426 may be configured to pause playback when a cabinet door (not shown), or other opening, is opened by a consumer for product retrieval, as described above in relation to FIGS. 3 and 3A.

Figure 5A:
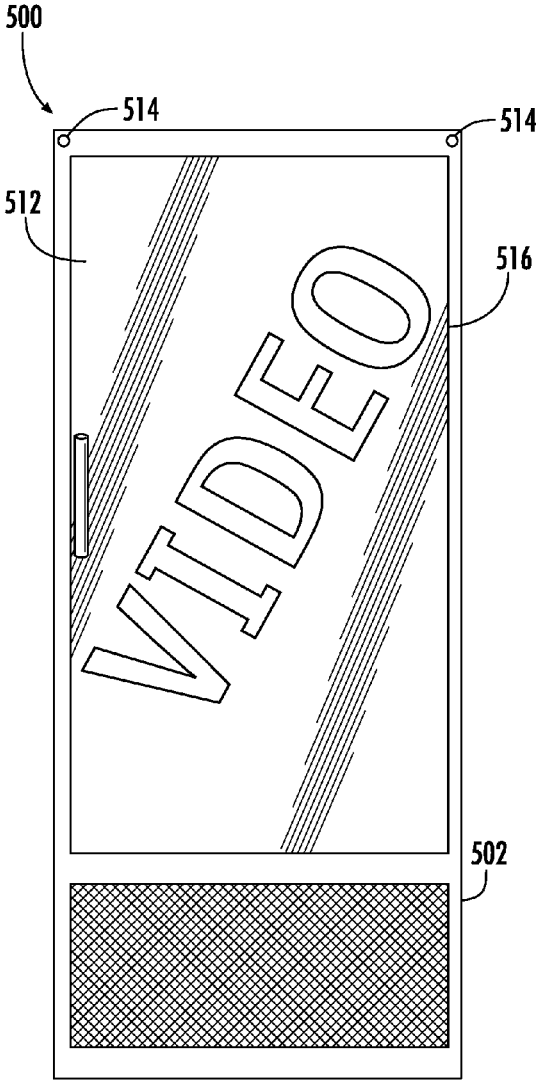
FIGS. 5A and 5B illustrate an another exemplary embodiment of a product merchandiser incorporating a video display, according to aspects described herein.
Figure 5B:
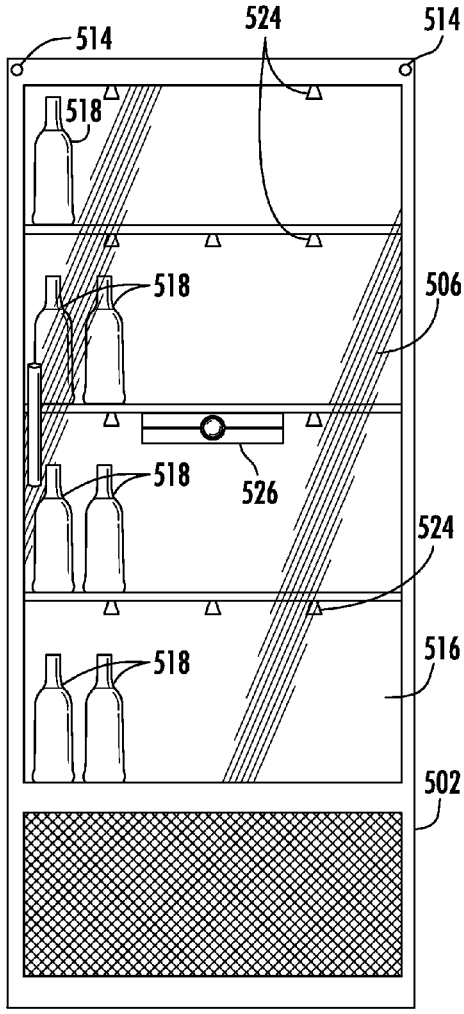

FIGS. 5A and 5B illustrate front views of another embodiment of an exemplary product merchandiser 500 incorporating a video display 512 on a front surface of door 516 of the merchandiser 500. Similar to the embodiments described above, merchandiser 500 may comprise an external cabinet 502 that may enclose and define one or more interior areas, such as a product display area 506 as can be seen through the merchandiser door 516 in FIG. 5B. The merchandiser 500 may comprise an opening such as cabinet door 516 for retrieval of one or more products 518 displayed within a product display area.

As described above, video display 512 may be positioned on a transparent surface, such as glass door 516 of merchandiser 500, or any other surface capable of displaying video image 512 projected from a video projector contained within, or proximate to the video display. External cabinet 502 may also comprise motion sensors or proximity sensors 514 for detecting the presence of a consumer. Motion/proximity sensors 514 may operate as described above in relation to the embodiments of FIGS. 1-4A.

Similar to the embodiments described above, the exemplary merchandiser of FIGS. 5A and 5B may further comprise one or more light(s) 524 for illuminating products contained in the merchandiser 500. As seen in FIG. 5A, and described in more detail above, when the presence of a consumer is detected by proximity or motion sensors 514, video display 512 may be paused by a video display control mechanism, as described above. Such a mechanism may comprise a microcontroller configured to communicate with a video projector 526 and other components of merchandiser 500, such that when a consumer approaches (as detected by proximity sensors 514) or opens door 516 of the merchandiser, the microcontroller signals the video projector to pause. When the door is subsequently closed, the controller may signal the video projector to resume video display 512. Proximity sensors 514 and/or door 516 may further control a switch for interior light(s) 524 such that either the presence of a consumer or the opening of door 516 causes light(s) 524 to illuminate, as understood in the art. With respect to the example depicted in FIGS. 5A and 5B, it should be understood that video display projector 526 may also be controlled manually or by other techniques as disclosed herein, and the present disclosure should not be interpreted as limited to the specific examples described herein.

Figure 6:
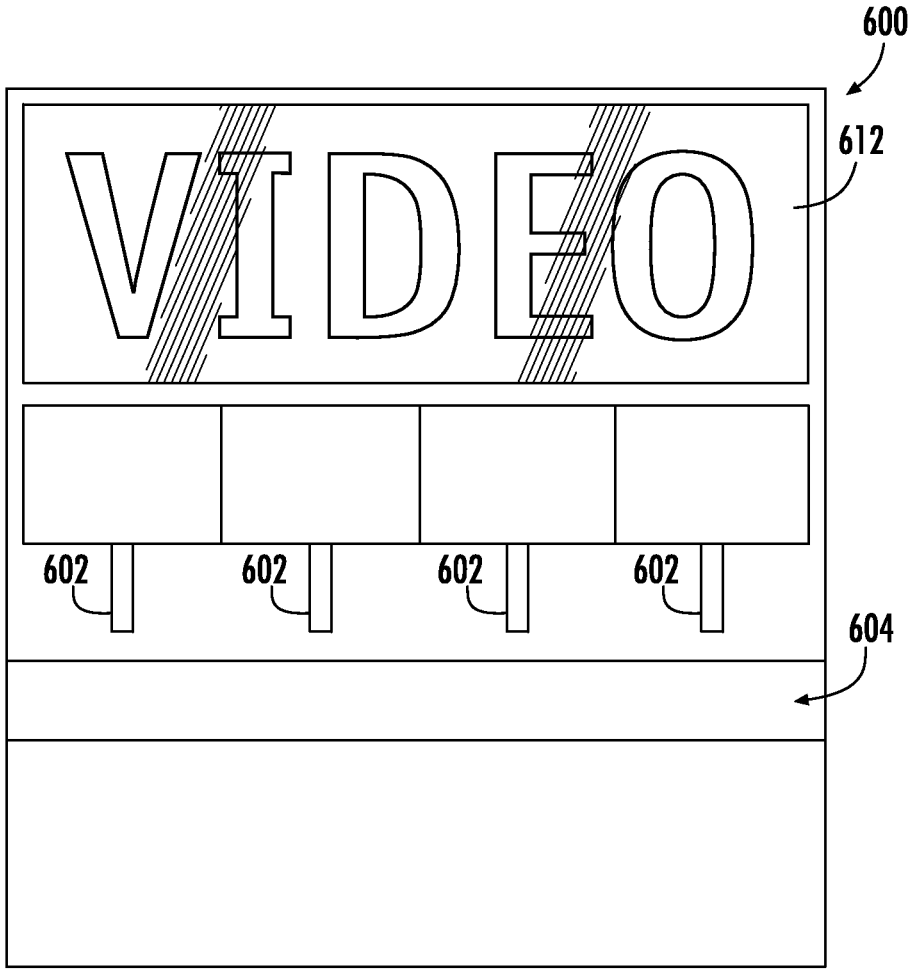
FIG. 6 illustrates yet another exemplary embodiment of a product merchandiser, according to aspects described herein.

FIG. 6 illustrates yet another exemplary embodiment of a product merchandiser 600 incorporating a video display 612, according to aspects described herein. The exemplary merchandiser 600 depicted in FIG. 6 comprises a beverage dispenser, with a plurality of beverage dispensing mechanisms 602. The beverage dispenser depicted in FIG. 6 may comprise a plurality of dispensing mechanisms 602 as well as a beverage dispensing area 604, as known to those skilled in the art. As can be seen, the merchandiser 600 may comprise a video display area 612, implemented according to techniques previously described herein. The product merchandiser 600 of FIG. 6 is depicted to further illustrate the breadth of the claims that follow.

While aspects of the disclosure have been described with respect to specific examples including presently preferred modes of carrying out the invention, those skilled in the art will appreciate that there are numerous variations and permutations of the above described systems and methods. For example, while the current disclosure has been directed to product merchandisers such as cooler merchandisers and beverage dispensers, those skilled in the art will recognize that the techniques described herein may be implemented on a variety of product merchandisers including vending machines or product dispensers not specifically described herein. Further, those skilled in the art will recognize that there are numerous configurations for product merchandisers and the various components of a merchandiser may be situated at different locations within a merchandiser cabinet/housing and still fall within the scope of the disclosure. For example, it is contemplated that the video display components, as described herein, may be situated proximate the opening of the merchandiser such that a video image is projected on a transparent surface comprising the opening, such as a door. Thus, the spirit and scope of the invention should be construed broadly as set forth in the appended claims.

What is claimed is:

1. A product merchandiser, comprising:

a cabinet having an exterior surface and being coupled to a door, wherein the cabinet defines an interior area, wherein at least a portion of the interior area is configured to hold a plurality of products, and wherein at least a portion of the exterior surface of the cabinet comprises a transparent surface;

a plurality of shelves located in the cabinet, the plurality of shelves holding the plurality of products;

a cooling unit located in the cabinet, the cooling unit configured to maintain a temperature for storing the plurality of products;

at least one proximity sensor located on the exterior surface of the cabinet, the proximity sensor configured to receive proximity data regarding presence of a consumer;

a video projector configured for projecting video;

a rear-reflective film adhered to an interior side of the transparent surface for rendering the video on an exterior side of the transparent surface; and a controller configured to:

receive proximity data from the proximity sensor regarding the presence of a customer;

cause the video projector to play a video on the rear-reflective film adhered to the transparent surface based on the received proximity data, the video including product description information regarding the plurality of products in the cabinet;

signal the video projector to pause the video at a point in the video in response to determining that the door is in an open position; and subsequently signal the video projector to resume presenting the video from the point that the video was paused in response to determining that the door is no longer in the open position.

2. The product merchandiser of claim 1, further comprising a mirror for reflecting the video from the video projector on the interior side of the transparent surface.

3. The product merchandiser of claim 1, wherein the at least a portion of the cabinet comprising the transparent surface configured to render the video is located at a topmost portion of the cabinet.

4. The product merchandiser of claim 1, wherein the door has a transparent viewing area for viewing the plurality of products from the exterior side of the cabinet.

5. The product merchandiser of claim 4, wherein the transparent surface configured to render the video is located on the door of the cabinet.

6. The product merchandiser of claim 1, wherein the video projector is located in the interior area of the cabinet.

7. The product merchandiser of claim 1, wherein the video projector is mounted on a rear exterior surface of the cabinet.

8. The product merchandiser of claim 1, wherein the door is a hinged door, wherein the interior of the cabinet further comprises at least one light, and wherein the at least one light is controlled by a switch configured to illuminate the at least one light when the hinged door is in the open position.

9. A product merchandiser configured to display video on an external surface of the product merchandiser, comprising:

a video display assembly comprising a video projector and a rear-reflective film adhered to an interior transparent surface of the product merchandiser;

a product area defined within the product merchandiser for holding at least one product;

at least one shelf located in the product merchandiser, the at least one shelf configured to hold the at least one product;

a cooling unit located in the product merchandiser, the cooling unit configured to maintain a temperature for storing the at least one product; at least one proximity sensor located on a surface of the product merchandiser, the proximity sensor configured to receive proximity data regarding presence of a consumer; and a controller configured to:

receive proximity data from the proximity sensor regarding the presence of a customer;

cause the video projector to play a video on the rear-reflective film adhered to the transparent surface based on the received proximity data, the video including product description information regarding the at least one product;

signal the video projector to pause the video at a point in the video in response to determining that a door of the product merchandiser is in an open position; and subsequently signal the video projector to resume presenting the video from the point that the video was paused in response to determining that the door is no longer in the open position.

10. The product merchandiser of claim 9, wherein the product merchandiser comprises a cabinet and the video display assembly is defined within the cabinet.

11. The product merchandiser of claim 10, wherein the video display assembly is mounted on the external surface of the product merchandiser, and wherein the video is projected from the video projector through an opening in the cabinet to the rear-reflective film adhered to an interior transparent surface of the cabinet.

12. The product merchandiser of claim 10, wherein an opening is defined in the cabinet for accessing the at least one product.

13. The product merchandiser of claim 12, wherein the door comprises a transparent viewing area for viewing the at least one product.

* * * * *